US007832325B1

(12) United States Patent
Hamann

(10) Patent No.: US 7,832,325 B1
(45) Date of Patent: Nov. 16, 2010

(54) BALLISTIC ARMOR SHIELD FOR HATCH AREA OF ARMORED VEHICLE

(75) Inventor: Darrell L. Hamann, North Andover, MA (US)

(73) Assignee: Darrell Hamann, North Andover, MA (US)

( * ) Notice: Subject to any disclaimer, the term of this patent is extended or adjusted under 35 U.S.C. 154(b) by 0 days.

(21) Appl. No.: 11/652,926

(22) Filed: Jan. 12, 2007

Related U.S. Application Data

(60) Provisional application No. 60/759,419, filed on Jan. 17, 2006.

(51) Int. Cl.
*F41H 5/013* (2006.01)

(52) U.S. Cl. ..... 89/36.13; 89/36.01; 89/918; 89/930

(58) Field of Classification Search ..... 89/36.01, 89/36.13, 36.14, 36.07–36.09
See application file for complete search history.

(56) References Cited

U.S. PATENT DOCUMENTS

| | | | | | |
|---|---|---|---|---|---|
| 2,436,374 | A | * | 2/1948 | Birdsall | 89/36.14 |
| 2,454,268 | A | * | 11/1948 | Brackett | 89/36.14 |
| 3,131,598 | A | * | 5/1964 | Bair | 89/36.08 |
| 3,724,323 | A | | 4/1973 | Selle | |
| 3,855,898 | A | * | 12/1974 | McDonald | 89/36.08 |
| 3,942,598 | A | * | 3/1976 | Council | 89/36.08 |
| 4,004,494 | A | | 1/1977 | Mechulam | |
| 4,280,393 | A | * | 7/1981 | Giraud et al. | 89/36.08 |
| 4,316,404 | A | * | 2/1982 | Medlin | 89/36.08 |
| 4,336,644 | A | * | 6/1982 | Medlin | 89/36.14 |
| D267,001 | S | * | 11/1982 | LeBlanc | D12/12 |
| 4,583,444 | A | | 4/1986 | Jackson | |
| 4,587,880 | A | | 5/1986 | Sprafke | |
| 4,643,477 | A | * | 2/1987 | Kovatch | 89/36.14 |
| 4,646,616 | A | | 3/1987 | Svensson | |
| 4,678,224 | A | * | 7/1987 | F'Geppert | 89/36.14 |
| 4,934,246 | A | * | 6/1990 | Benson et al. | 89/36.14 |
| 5,128,803 | A | * | 7/1992 | Sprafke | 89/36.14 |
| 5,487,323 | A | | 1/1996 | Madden, Jr. | |
| 5,594,193 | A | | 1/1997 | Sheridan | |
| 5,847,308 | A | | 12/1998 | Singh | |
| 6,302,010 | B1 | * | 10/2001 | Holler | 89/36.08 |
| 6,647,857 | B1 | | 11/2003 | Newkirk | |
| 6,711,980 | B2 | * | 3/2004 | Kropf | 89/36.09 |
| 6,845,701 | B2 | * | 1/2005 | Drackett | 89/36.09 |
| 6,886,447 | B2 | | 5/2005 | Crotty | |
| 7,007,585 | B2 | | 3/2006 | Gonzalez | |
| 7,100,991 | B2 | | 9/2006 | Scroth | |

(Continued)

*Primary Examiner*—Michael Carone
*Assistant Examiner*—Jonathan C Weber

(57) ABSTRACT

A ballistic armor shield assembly attached to a Stryker armored vehicle comprises a three-sided armor shield assembly with transparent armor, which is bolted around a driver hatch directly onto the military armored vehicle using existing bolts and holes. The armor shield assembly comprises a front, left and right side armor frames forming the 3-sided assembly to which transparent armor (ballistic glass) sections are attached and secured. An enclosure is provided on the left side of the armored shield assembly for attaching and removing the entire left side transparent armor in order to facilitate vehicle engine maintenance. The driver is provided with full armor protection while operating the vehicle with his body extending out of the open hatch for improved vision. When the hatch is partially closed, the driver has full protection on the front, left, and right from the armor shield assembly as well as above from the hatch.

9 Claims, 11 Drawing Sheets

U.S. PATENT DOCUMENTS

| | | | | |
|---|---|---|---|---|
| 7,191,694 | B1 * | 3/2007 | Gonzalez | 89/36.02 |
| 7,232,181 | B2 * | 6/2007 | Schmucker | 89/36.09 |
| 7,411,648 | B2 * | 8/2008 | Ishida | 349/161 |
| 2002/0170420 | A1 | 11/2002 | Falk | |
| 2003/0192426 | A1 | 10/2003 | Peretz | |
| 2003/0213359 | A1 * | 11/2003 | Kropf | 89/36.09 |
| 2004/0159228 | A1 | 8/2004 | Budnik | |
| 2004/0227390 | A1 | 11/2004 | Schroth | |
| 2004/0237764 | A1 | 12/2004 | Crotty | |
| 2004/0255768 | A1 | 12/2004 | Rettenbacher | |
| 2004/0255769 | A1 * | 12/2004 | Drackett | 89/36.09 |
| 2005/0087064 | A1 | 4/2005 | Cohen | |
| 2005/0115395 | A1 | 6/2005 | Chassillian | |

* cited by examiner

BALLISTIC ARMOR SHIELD FOR HATCH AREA OF ARMORED VEHICLE

CROSS REFERENCE TO RELATED APPLICATIONS

This application claims the benefit of U.S. Provisional Application No. 60/759,419, filed Jan. 17, 2006, which is incorporated by reference herein in its entirety.

BACKGROUND OF THE INVENTION

1. Field of the Invention

This invention relates generally to ballistic armor shielding for military armored vehicles operating in combat zones, hostile environments and extreme weather conditions, and in particular, to a three sided (front, left and right) ballistic armor shielding for a Stryker armored vehicle to provide the driver with maximum safety when operating the vehicle with the driver hatch open, partially open or closed.

2. Description of Related Art

Stryker or other military armored vehicle original designs provide for a mud shield when operating the vehicle with the hatch open, partially open, or with the hatch closed. The driver views the terrain through a periscope or small monitor from inside the vehicle. Limitations to this design include the driver either being open to attack while driving with the hatch open and/or the driver having a limited view of his environment with blind spots while operating with the hatch closed. The driver of a military vehicle needs to safely maneuver brigade combat teams in close and urban environments as well as open terrain.

Given these limitations, most military armored vehicle drivers operate the vehicle with the hatch open so that they can better view the terrain around them, and this leaves the driver totally exposed to enemy attack. When the hatch is closed, the driver experiences blind spots when operating the armored vehicle. If the driver is in harms way, then his entire vehicle crew and its contents are at high risk.

Various hatch cover arrangements are known in the prior art such as the following:

U.S. Pat. No. 3,724,323, issued Apr. 3, 1973 to Wolfgang H. Selle, discloses a rotatable hatch cover for an armored vehicle having five (5) windows, and a collar which co-operatively engages the hatch cover to fully enclose the hatch opening. The hatch cover is rotatably mounted to a pair of pivot bearings about a central axis of rotation and the hatch cover pivots into the hatch opening adjacent to and inside of the armored collar to provide an unobstructed hatch opening. However, there is no protection for an operator looking out when the hatch cover is raised.

U.S. Pat. No. 4,004,494, issued Jan. 25, 1977 to André Mechulam, et al., discloses a military observation post such as a roof of a turret of an armored vehicle having an opening allowing passage of at least the head of an operator. The opening is closed by a transparent cover of plastic material and the transparent cover is covered by an armored hatch cover having a hemispherical shape. The transparent cover is fixed to the frame adapted for being seated on a rim surrounding the operation opening, and the armored cover and the frame are articulated on a common axle fixed to the roof proximate to the periphery of the frame. However, when the armored hatch cover is closed, the operator has no visibility through the hatch cover.

U.S. Pat. No. 4,583,444, issued Apr. 22, 1986 to Theodore A. Jackson, shows an armored vehicle with a rotatable swing away turret. The turret comprises a pair of weapons and an observation dome having a plurality of windows with limited visibility.

U.S. Pat. No. 4,646,616, issued Mar. 3, 1987 to Hakan Svensson, shows an armored hatch cover for a combat vehicle which is pivotally mounted between an open position and a closed position. The cover is pivotally supported on a bolt behind the cover by means of two arms. When the cover is in an open position, a small annular gap is formed which provides a substantially narrow all-around view.

U.S. Pat. No. 6,886,447, issued May 3, 2005 to Jeffrey Crotty, et al., shows a hatch assembly for a portal of an armored vehicle comprising a structure defining the portal of an armored vehicle, a hatch positionable over the portal, and a hatch operating mechanism assembly coupled to said hatch for shifting the hatch between a first position covering the portal and a second position clearing the portal. However, when the portal is open, there is no protection for personal.

SUMMARY OF THE INVENTION

Accordingly, it is therefore an object of this invention to provide a ballistic armor shield assembly for installation around a driver's hatch of a military armored vehicle and particularly a Stryker armored vehicle whereby the hatch may be fully closed, partially open, or fully open and a driver has armor protection.

It is another object of this invention to provide a ballistic armor shield assembly that attaches to a Stryker armored vehicle using existing bolts and holes already on the vehicle.

It is a further object of this invention to provide a ballistic armor shield assembly on a Stryker armored vehicle that does not inhibit access to an engine compartment of the vehicle.

These and other objects are further accomplished by an armor shield assembly comprising a right side armor frame having a first open area, a first transparent armor positioned in the first open area and attached to the right side armor frame, a front armor frame having a second open area and a first edge of the front armor frame being attached to an adjacent first edge of the right side armor frame, a second transparent armor positioned in the second open area and attached to the front armor frame, a left side armor frame having a third open area and a first edge of the left side armor frame being attached to a second adjacent edge of the front armor frame, and a transparent armor assembly positioned in the third open area and attached to the left side armor frame. The transparent armor enclosure comprises a third transparent armor, and a cover for receiving the third transparent armor forming the enclosure, the enclosure being attached to the left side armor frame. The armor shield assembly comprises a right side armor cover for positioning within a recessed border portion of the first transparent armor, and a front armor cover for positioning within a recessed border portion of the second transparent armor. The third transparent armor of the armor shield assembly comprises a recessed border portion and a non-recessed portion wherein the non-recessed portion fits within the third open area of the left side armor frame.

The armor shield assembly comprises a bottom armor frame attached to bottom edges of the right side armor frame, the front armor frame, and the left side armor frame, and the bottom armor frame comprises a plurality of holes for mounting said armor shield assembly to an armored vehicle. The armor shield assembly comprises a top armor frame to which a top edge of the right armor frame and a top edge of the front armor frame are attached. A channel is provided in a lower corner below where the first edge of the front armor frame and the adjacent first edge of the right side armor frame, the channel provides an opening for a cable winch to pass through. The armor shield assembly comprises a windshield wiper assembly mounted on the top armor frame and a camera bracket mounted on the top armor frame. The left side armor frame comprises a bracket having a hole and the bracket extends away from the frame for mounting of the armor shield assembly. Each of the first transparent armor, the second transparent armor, and the third transparent armor comprises a combination of layers of polycarbonate and glass to a predetermined thickness.

These and other objects are further accomplished by an armor shield assembly for mounting adjacent to a hatch on an armored vehicle comprising a front section having a first transparent armor secured within a front frame, a right side section having a second transparent armor secured within a second frame, the right side section being attached perpendicular to a first end of the front section, a left side section having a third transparent armor secured within a third frame, the left side section being attached perpendicular to a second end of the front section, a bottom frame section attached to the right side section, the front section and the left side section comprises a plurality of mounting holes, and a top frame section attached to the right side section and the front section. The front section slopes backward at approximately a twenty degree angle with respect to a vertical axis perpendicular to a front leg of the bottom frame section. The third transparent armor comprises a cover for supporting the third transparent armor forming an enclosure, the enclosure being attached to the left side armor frame. The armor assembly comprises a right side armor cover for positioning within a recessed border portion of the first transparent armor, the right side armor cover being secured to the second frame, and a front armor cover for positioning within a recessed border portion of the second transparent armor. A channel is provided in a lower corner below an intersection of the front section and the right side section, the channel providing an opening for a cable winch to pass through. The top frame section comprises a windshield wiper assembly and a camera bracket. The left side section comprises a bracket having a hole, the bracket extending away from the left side section for mounting of the armor shield assembly on the armored vehicle, and each of the first transparent armor, the second transparent armor, and the third transparent armor comprises a combination of layers of polycarbonate and glass to a predetermined thickness.

These and other objects are further accomplished by a method for providing an armor shield assembly for mounting around three sides of a hatch on an armored vehicle comprising the steps of providing a right side armor frame having a first open area, installing a first transparent armor in the first open area of the right side armor frame, providing a front armor frame having a second open area wherein a first edge of the front armor frame is attached to an adjacent first edge of the right side armor frame, installing a second transparent armor in the second open area of the front armor frame, providing a left side armor frame having a third open area wherein a first edge of the left side armor frame is attached to a second adjacent edge of the front armor frame, installing a transparent armor enclosure in the third open area of the left side armor frame, attaching a bottom armor frame to bottom edges of the right side armor frame, the front armor frame, and the left side armor frame, and providing a top armor frame to which a top edge of the right armor frame and a top edge of the front armor frame are attached. The step of installing a transparent armor assembly comprises the steps of providing a third transparent armor, and installing the third transparent armor in a cover to form the transparent armor enclosure. The method comprises the steps of positioning a right side armor cover within a recessed border portion of the first transparent armor, and positioning a front armor cover within a recessed border portion of the second transparent armor. The method further comprises the steps of providing the bottom armor frame with a plurality of holes for mounting the armor shield assembly to an armored vehicle, providing a channel in a lower corner below where the first edge of front armor frame and the adjacent first edge of the right side armor frame, said channel providing an opening for a cable winch to pass through, providing a top armor frame comprising the steps of mounting a windshield wiper assembly and a camera bracket on the top armor frame, and providing a concave radius in a back edge of the top armor frame to allow the opening and closing of a hatch on an armored vehicle. The step of providing a left side armor frame comprises the step of providing a bracket having a hole extending away from the left side armor frame for mounting the armor shield assembly to the armored vehicle. The steps of installing a first transparent armor, a second transparent armor and a third transparent armor comprises the steps of providing a first, second and third transparent armors made from a combination of layers of polycarbonate and glass to a predetermined thickness. The method further comprises the steps of mounting a camera assembly in the camera bracket, the camera assembly being off-center from a center position of the armored vehicle, and providing an alignment bar on a front surface of said armored vehicle in front of the armor shield assembly, the alignment bar providing a cross-hair in the camera assembly for centering the armored vehicle.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENT

Figure 1:
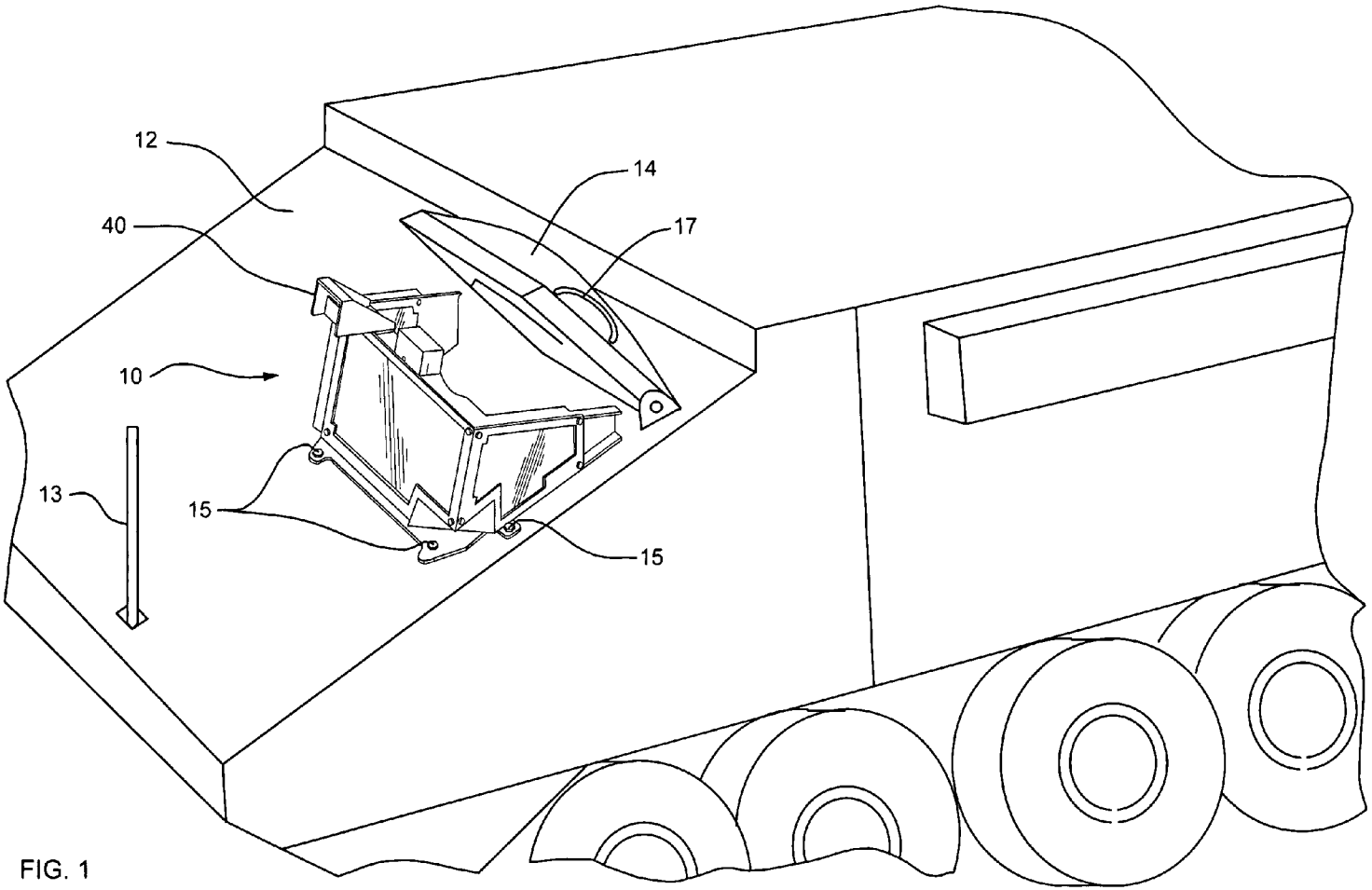
FIG. 1 is a front perspective view of an armor shield assembly mounted around three sides of a hatch of an armored vehicle according to the present invention.
Figure 2:
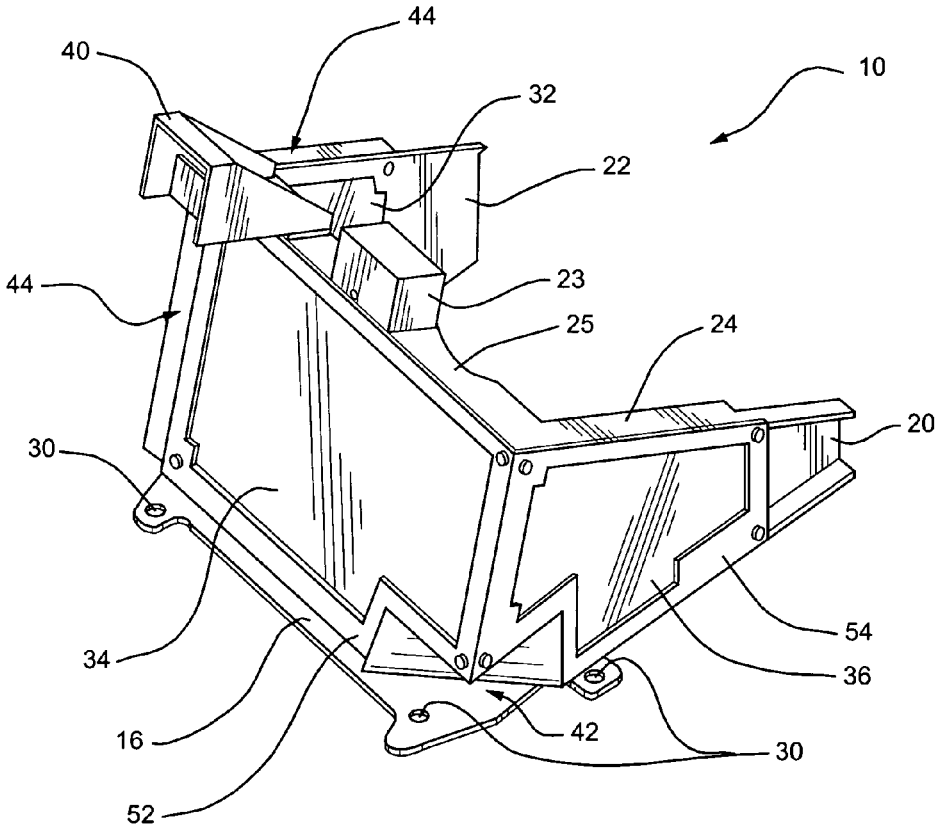
FIG. 2 is a top perspective view of the armor shield assembly according to the present invention.

Referring to FIG. 1 and FIG. 2, FIG. 1 is a top perspective view of a ballistic armor shield assembly 10 installed around three sides of the periphery of a hatch 14 on an armored vehicle such as a Stryker armored vehicle 12, and FIG. 2 is an enlarged top perspective view of the armor shield assembly 10 according to the present invention. The ballistic armor shield assembly 10 is easily installed on the Stryker armored vehicle 12 by simply bolting it to existing holes on the armored vehicle 12 using existing bolts 15, and it provides an otherwise exposed driver with shielding on three sides and an unobstructed 270 degree view of the surrounding terrain. The armored shield works as an integrated component on the Stryker armored vehicle 12 allowing the driver to take advantage of the hatch 14 as an integrated part of the three sided armor shield assembly 10. The hatch 14 functions as the top cover of the armor shield assembly 10, giving the driver complete protection on all sides and from above by the hatch 14 when it is partially open. The hatch 14 comprises handles 17 on top and may be operated in an open, partially open or fully closed position.

A vehicle alignment bar 13 is mounted on the front surface of the armored vehicle 12 in front of the armor shield assembly 10 to provide internal centering capability when the driver is operating with the hatch 14 closed and viewing through an internal monitor. A camera assembly 40 that normally mounts on the center of the armored vehicle 12 is moved off-center to mount on top of the armor shield assembly 10. The alignment bar 13 provides a cross-hair for centering the armored vehicle 12 when using the off-centered camera assembly 40.

Figure 3:
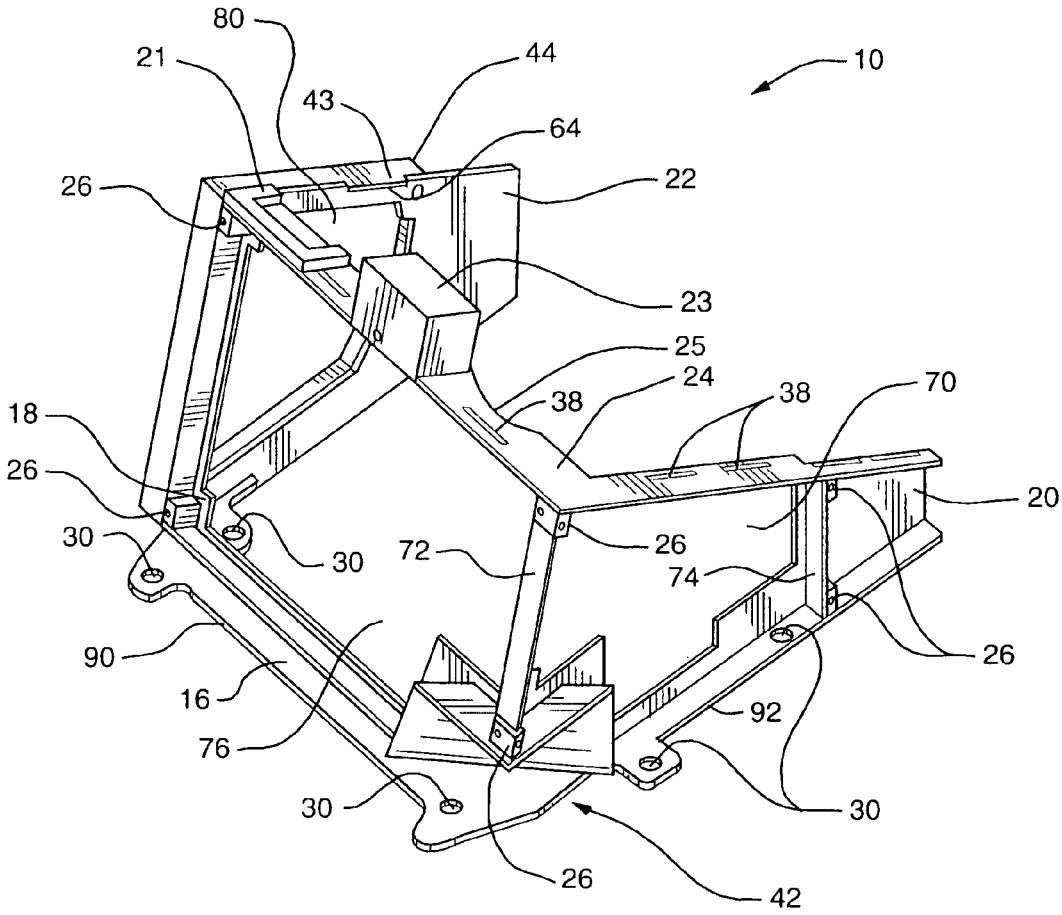
FIG. 3 is a top perspective view of the armor frame sections of the armor shield assembly with armor covers and transparent armor sections removed.
Figure 5:
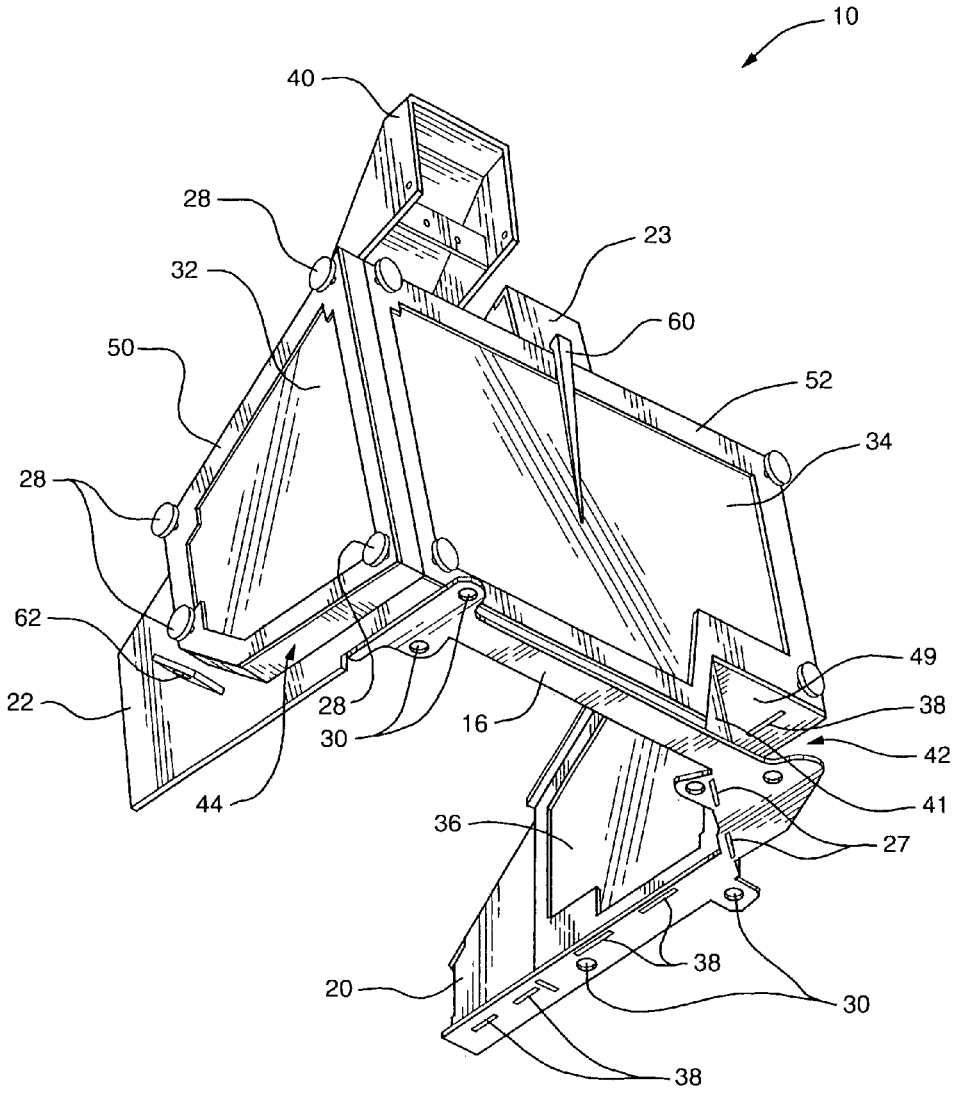
FIG. 5 is a bottom perspective view of the armor shield assembly according to the present invention.

Referring to FIG. 2 and FIG. 3, FIG. 3 is a top perspective view of the armor shield assembly 10 with armor covers 52 and 54 and transparent armor sections 32, 34, 36 removed. FIG. 3 shows only the armor frame sections 16-24 and retention blocks 26 with tapped holes which are welded in corners for receiving twist release knobs 28 (FIG. 5) when the armor shield assembly 10 is completely assembled. The ballistic armor shield assembly 10 comprises a bottom armor frame section 16, a front armor frame section 18, a right side armor frame section 20, a left side armor frame section 22 and a top armor frame section 24. The front armor frame section slopes backward approximately 20 degrees from a line perpendicular to the front leg 90 of the bottom armor frame section 16. At the upper and lower corners of the armor shield assembly 10 where the left and right side armor frames 20, 22 connect with the front armor frame 18, retention blocks 26 (FIG. 3) containing holes are mounted. The retention blocks 26 comprise ⅜ inch—16 threaded holes for receiving twist release knobs 28 (FIG. 5). Two additional blocks 26 are provided on a right portion of the right side armor frame 20 and on a left portion of the left side armor frame 22. The bottom armor frame 16 comprises six (6) holes 30 (FIG. 5) for inserting bolts into existing holes on the armor shield assembly 10 that secures the armor shield assembly 10 to the Stryker armored vehicle 12. The top armor frame 24 comprises a camera mounting bracket 21 and a windshield wiper box 23, both of which attach to the upper surface of the top armor frame 24. A back edge of the top armor frame 24 immediately adjacent to the windshield wiper box 23 comprises a concave radius 25 to provide clearance for a hand of a driver of the Stryker armored vehicle 12 to open and close the hatch 14 without interference from the armor shield assembly 10.

Figure 4A:
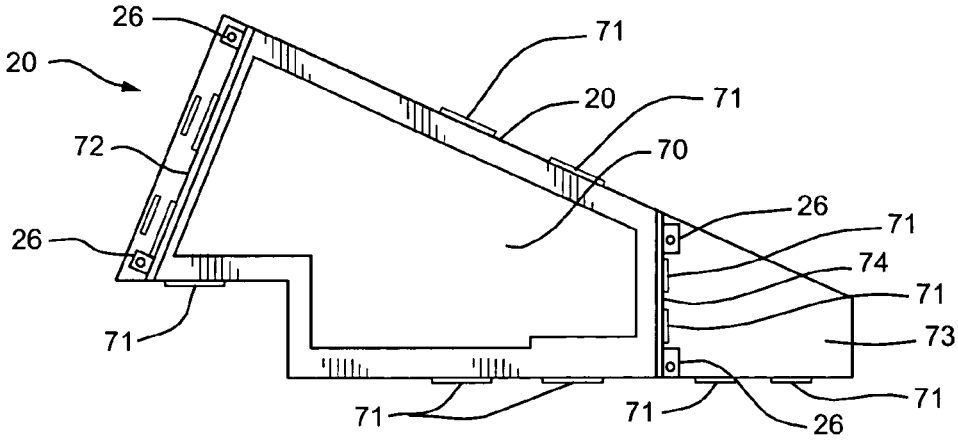
FIG. 4A is a front elevational view of a right side armor frame section.
Figure 4B:
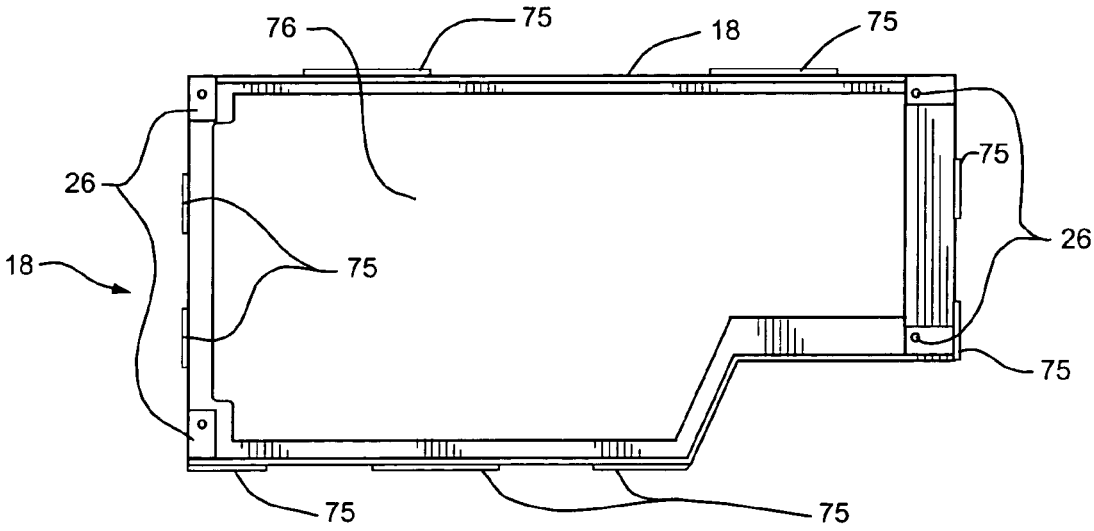
FIG. 4B is a front elevational view of a front armor frame section.
Figure 4C:
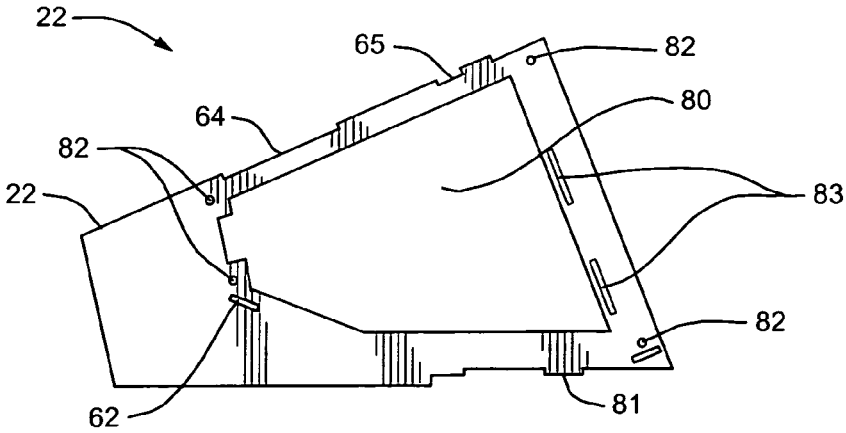
FIG. 4C is a front elevational view of a left side armor frame section.
Figure 4D:
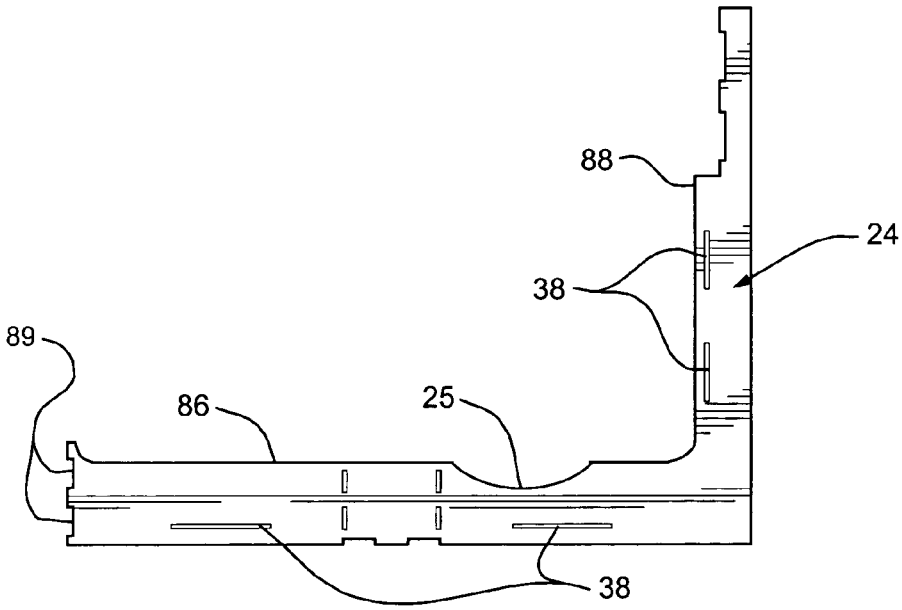
FIG. 4D is a top view of a top armor frame section.
Figure 4E:
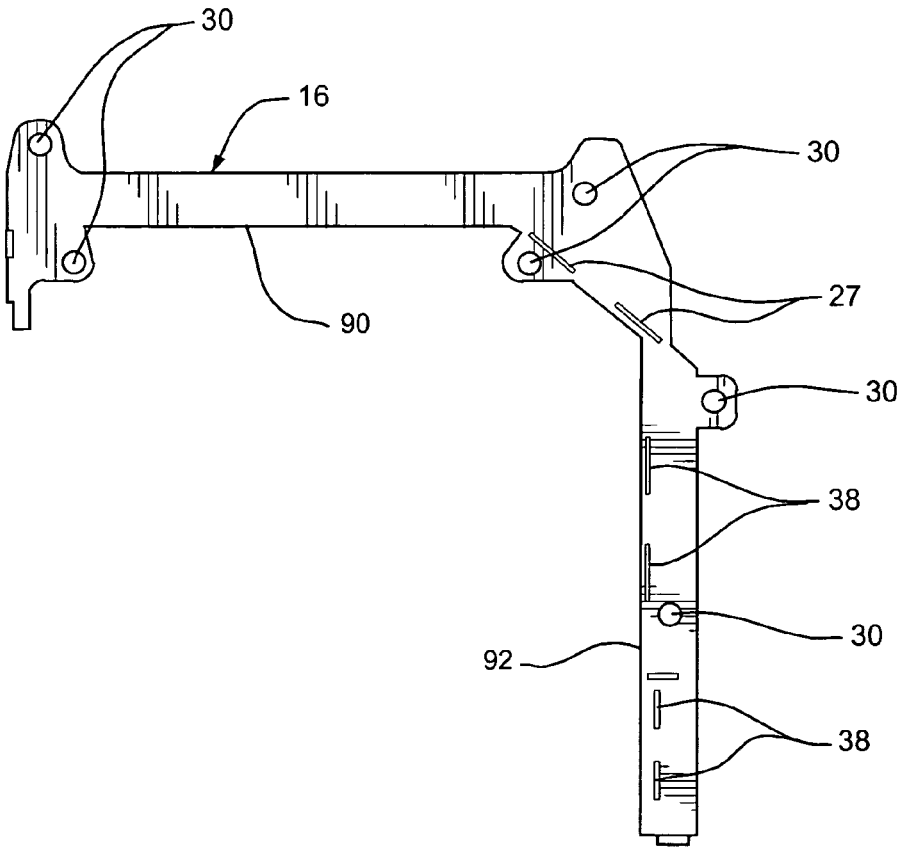
FIG. 4E is a bottom view of a bottom armor frame section.

Referring to FIG. 3 and FIGS. 4A, 4B, 4C, 4D and 4E, FIGS. 4A-4C show front elevational views of the right side armor frame section 20, the front armor frame section 18 and the left side armor frame section 22. FIG. 4D shows a top view of the top armor frame section 24 and FIG. 4E shows a bottom view of the bottom armor frame section 16. In FIG. 4A the right side armor frame section 20 comprises an opening 70 for receiving the right side transparent armor section 36. Two vertical panels 72, 74 are positioned adjacent to the sides of the opening 70 and retention blocks 26 are welded to the upper and lower outside surfaces of the panels 72, 74. A panel 73 is welded on the right side of panel 74 having tabs 71 extending from the bottom edge for insertion into the mating slot 38 in the bottom armor frame section 16. The notch in the lower left corner of the right side armor frame section provides for the formation of a cable winch channel 42. Tabs 71 are provided on the top and bottom edges of the right side armor frame section 20 which fit into slots 38 on the top armor frame section 24 and slots 38 in the bottom armor frame section 16 driving assembly and maintain the frame sections in final position prior to welding of the tabs in the slots.

Referring to FIG. 4B, the front armor frame section 18 comprises an opening 76 for receiving the front transparent armor section 34. A notch in the lower side corner provides for the formation of the cable winch channel 42. Retention blocks 26 are welded on the left side at the top and bottom corners of the front armor frame 18 for receiving twist release knobs 28. Nine (9) tabs 75 are provided on the outer edges of the front armor frame section 18 for mating with slots in other frame sections 16, 20, 22, 24 during assembly of the armor shield assembly 10 prior to welding.

Figure 8:
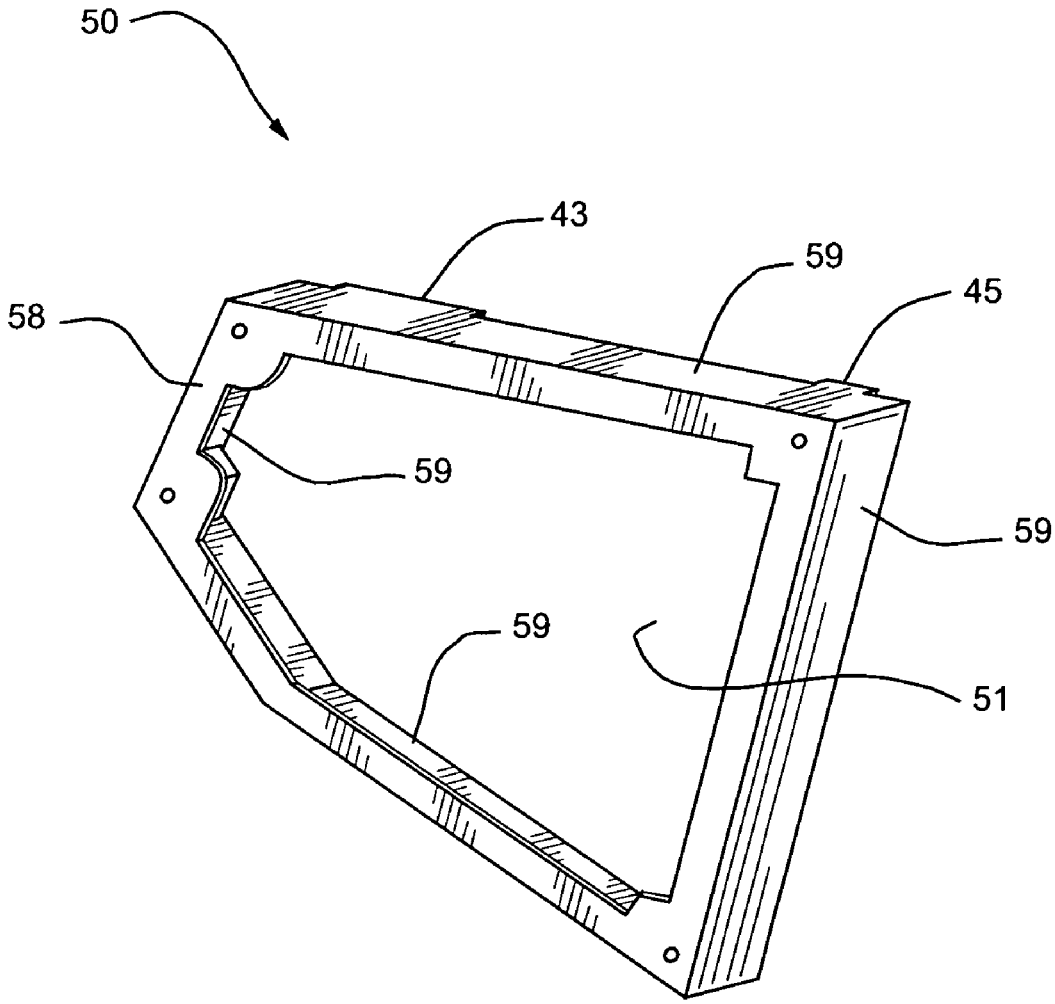
FIG. 8 is a top perspective view of the left side armor cover.

Referring to FIG. 4C, the left side armor frame section 22 comprises an opening 80 for receiving the left side transparent armor section 32. Notches 64, 65 are provided on the top edge of the frame section 22 for receiving tabs 43, 45 that extend from the top surface of the left side armor cover 50 (FIG. 8). A bracket 62 extends away from the side of the left side armor frame section 22, and the bracket 62 is positioned at an angle parallel to the lower left side of the left side armor cover 50 when it is attached to the left side armor frame section 22. The bracket 62 provides a hole for another mounting bolt to be inserted and secured into a front sloping section of the armored vehicle 12. There are four threaded holes 82 of ⅜ inch—16 thread on the corners of the left side armor frame section 22 adjacent to opening 80 which are positioned to receive the bolts of twist release knobs 28 for securing the enclosure 44 to the left side armor frame section 22. A combination of notches 64, 65, and tab 81 on the top and bottom edges of the left side armor frame section 22 and slots 83 are used to facilitate assembly of the armor shield assembly 10 prior to welding of mating tabs into slots.

Referring to FIG. 4D, a top view of the top armor frame section 24 shows the slots 38 provided in a front leg 86 and a side leg 88 for use during initial assembly of the armor frame sections. Tabs 71 extend from the top of the right side armor frame section 20 and fit into adjacent slots 38 of the side leg 88 of the top armor frame section 24, and tabs 75 on top of the front armor frame section 18 fit into the adjacent slots 38 of the front leg 86 of the top armor frame section 24. The concave radius 25 provides clearance for a hand of a driver of the armored vehicle 12 to open and close the hatch 14. The left end of the front leg 86 comprises notches 89 for mating with the top edge of the left side frame section 22.

Referring to FIG. 4E, a bottom view of the bottom armor frame section 16 is shown comprising six mounting holes 30, two being positioned at one end of a front leg 90, two holes positioned along a side leg 92 and two holes positioned at the area of intersection of the front leg 90 and the side leg 92. Slots 27 and 38 are provided for receiving tabs 71 on the bottom edge of the right side frame section 20 and a corner plate 41 which forms a wall of the channel 42.

Referring to FIG. 5, a bottom perspective view of the armor shield assembly 10 is shown having the transparent armor (or ballistic glass) sections 32, 34, 36 and armor covers 50, 52, 54 attached. The left side transparent armor 32 is mounted in a separate cover 50 forming a transparent armor enclosure 44 which is attached to the left side armor frame 22 with quick release knobs 28 so that it can be removed to allow an engine cover to be raised for maintenance of the armored vehicle 12. The six attachment holes 30 are shown on the bottom armor frame section 16 for mounting the armor shield assembly 10 to the Stryker armored vehicle 12 without any modifications. A bracket 62 is provided on the front of the left side armor frame section 22. Slots 38 are provided in the bottom armor frame section 16 for use during manufacturing of the armor shield assembly 10. A camera assembly 40 is attached to the camera bracket 21. A windshield wiper blade 60 extends from the windshield wiper box 23 in front of transparent armor section 34. A cable winch channel 42 is provided in the lower front right corner of the armor shield assembly 10 for passage of a cable to the front of the armored vehicle 12. The enclosure 44 for the left side transparent armor 32 is shown and four twist release knobs 28 secure enclosure 44 to the left side of the armor shield assembly 10. The enclosure 44 comprises a cover 50 and the transparent armor section 32 and generally has the shape of the transparent armor section 32 which is mounted within the cover 50. The edges of the inner side and the outer side of the transparent armor sections 32, 34, 36 are cut back a depth of 0.25 inches from the outer edge on both the inside and outer side of the ballistic glass sections to form recessed borders 33, 35, 37.

A handle may be mounted on top of enclosure 44 to provide ease of handling and removing the enclosure 44 when the four twist release knobs 28 are removed. The twist release knobs 28 eliminate the need for a tool to remove the enclosure 44; however, bolts may be used instead of the twist release knobs 28 in some applications.

Figure 6A:
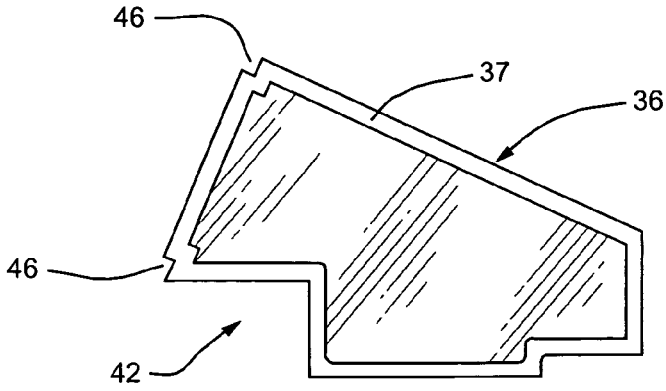
FIG. 6A is a front elevational view of a right side transparent armor section.
Figure 6B:
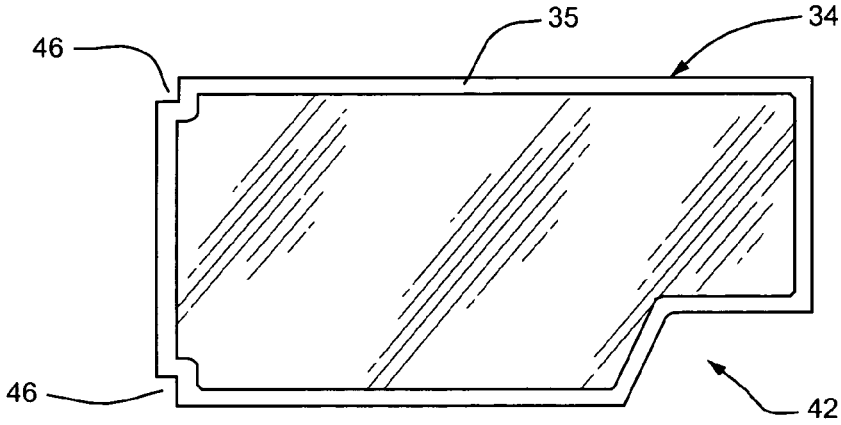
FIG. 6B is a front elevational view of a front transparent armor section.
Figure 6C:
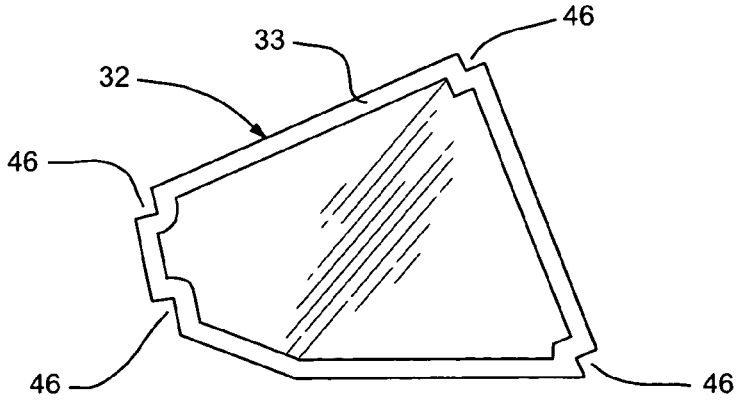
FIG. 6C is a front elevational view of a left side transparent armor section.

Referring to FIG. 6A, FIG. 6B and FIG. 6C, front elevational views of the transparent armor (ballistic glass) sections 32, 34, 36 are shown. The left side transparent armor 36 as shown in FIG. 6A mounts within the right side armor frame section 20. The front transparent armor 34 of FIG. 6B mounts within the front armor frame section 18. The left side transparent armor 32 of FIG. 6C mounts within the left side armor cover 50 (FIG. 8) forming enclosure 44 (FIG. 5) which attaches to the left side armor frame 22 using the twist release knobs 28. A combination of a rubber gasket, two sided sticky tape and silicone is used to initially retain the transparent armor sections 32, 34, 36 within their respective armor cover 50 or armor frames 18, 20 prior to attaching the armor covers 50, 52 and 54 to the armor frames 22, 18, 20, respectively. The front and back surfaces of the transparent armor sections 32, 34, 36 both comprise the recessed borders 33, 35, 37 which are approximately 0.25 inches deep and 0.75 inches wide on both the front and the back surfaces in the preferred embodiment. The recessed borders 33, 35, 37 on the front surface of transparent armor sections 32, 34 and 36 receive the armor covers 50, 52, 54 respectively, and the similar recessed borders on the back surfaces allow the transparent armor sections 32, 34, 36 to fit within the left side armor frame 22, the front armor frame 18 and the right side armor frame 20 respectively providing a positive secure fit.

The transparent armor sections 32, 34, 36 comprise a multi-layer combination of polycarbonate and glass and are intended to meet a minimum of protection of the National Institute of Justice (NIJ) Level Four (4) Ballistic and Blast Standard. The transparent armor sections 32, 34, 36 are approximately 2.5 inches thick and have the geometric configurations shown in FIGS. 6A, 6B and 6C. The recessed borders 33, 35, 37 around each of the transparent glass section 32, 34, 36 are approximately 0.25 inches deep and 0.75 inches wide in the preferred embodiment, and they are on the front and back surfaces of the transparent armor sections 32, 34, 36. Therefore, the thickness of the transparent armor at the recessed borders is approximately 2.0 inches. The lower left corner of the right side transparent armor section 36 and the lower right corner of the front transparent armor section 34 have cut-outs to provide for the formation of the cable winch channel 42.

The notched corners 46 of the transparent armor sections 32, 34, 36 are provided for passage of twist release knobs 28 having two inch through bolts to secure the transparent armor sections 32, 34, 36 with armor covers 50, 52, 54 within the armor shield assembly 10. The angle of the top edge of the right side transparent armor section 36 and the angle of the top edge of the left side transparent armor section 32 are set to align the armor shield assembly 10 with the hatch 14 of the armored vehicle 12. The transparent armor sections 32, 34, 36 may include a heater/defrost capability which is laminated into or onto each of the transparent armor sections 32, 34, 36 and connected through a controller to a 24 volt connection in the armor vehicle 12. The transparent armor sections 32, 34 and 36 may be embodied by products manufactured by various high skilled transparent armor manufacturers. One skilled in the art will recognize that other transparent armor (polycarbonate/glass) materials may be used to provide additional protection and lighter weights.

Referring to FIG. 5, FIGS. 7A, 7B, 7C and FIG. 8, FIGS. 7A, 7B, and 7C are front elevational views of the right side armor cover 54, the front armor cover 52 and the left side armor cover 50, and FIG. 8 is a top perspective view of the left side armor cover 50. The armor material for all covers 50-54 are approximately 0.25 inches thick and the recessed borders 33, 35, 37 around the transparent armor sections 32, 34, 36 have a depth of approximately 0.25 inches. The right side transparent armor section 36 fits within the open area 55 of right side armor cover 54, and the right side cover 54 fits within the recessed borders 37 resulting in the outer surface of the right side cover 54 being flush with the outer surface of the transparent armor section 36. The front transparent armor section 34 fits within the open area 53 of the front armor cover 52, and the front armor cover 52 fits within the recessed border 35 of the front transparent armor 34 resulting in the outer surface of the front armor cover 52 being flush with the outer surface of the front transparent armor 34.

Figure 7A:
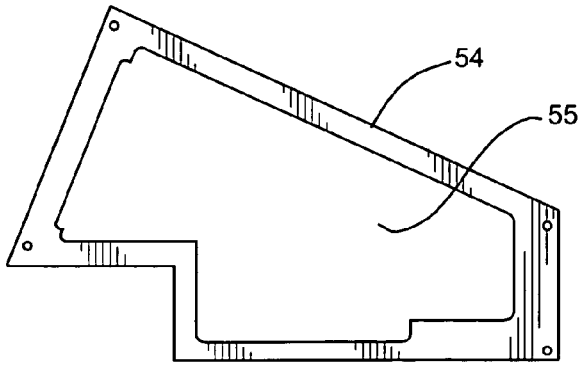
FIG. 7A is a front elevational view of a right side armor cover.
Figure 7B:
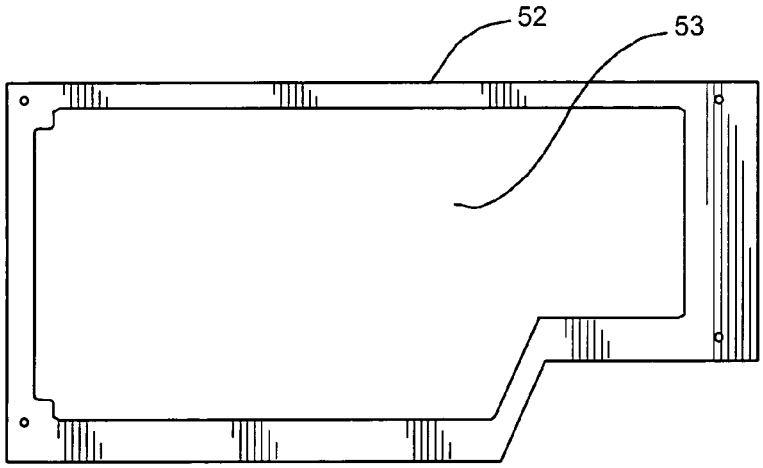
FIG. 7B is a front elevational view of a front armor cover.
Figure 7C:
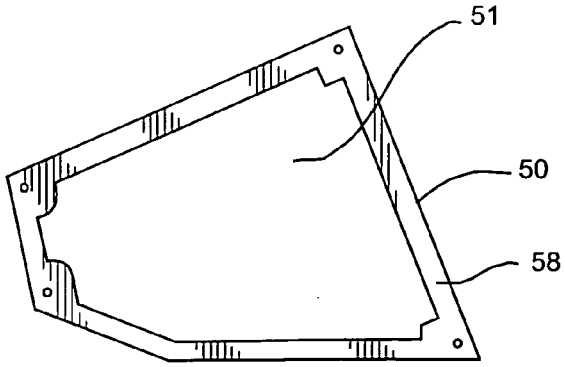
FIG. 7C is a front elevational view of a left side armor cover.

Referring to FIGS. 7C and 8, FIG. 8 shows a top perspective view of the left side armor cover 50 comprising an open area 51 within an outer surface 58 and sides 59. The left side transparent armor 32 fits within the left side armor cover 50 forming enclosure 44 (FIG. 5), and the enclosure 44 attaches to the left side armor frame 22 of the armor shield 10 by the twist release knobs 28. The outer surface 58 of the left side cover 50 fits within the recessed border 33 of the left side transparent armor 32, and the outer surface 58 is flush with the outer surface of the transparent armor 32. Two tabs 43, 45 are provided on the top of the left side armor cover 50 and the tabs 43, 45 extend approximately 0.25 inches. These tabs 43, 45 fit into notches in the top edge of the left side armor frame 22

(See FIG. 9) to provide a positive fit when the enclosure 44 is attached to the left side armor frame 22.

Figure 9:
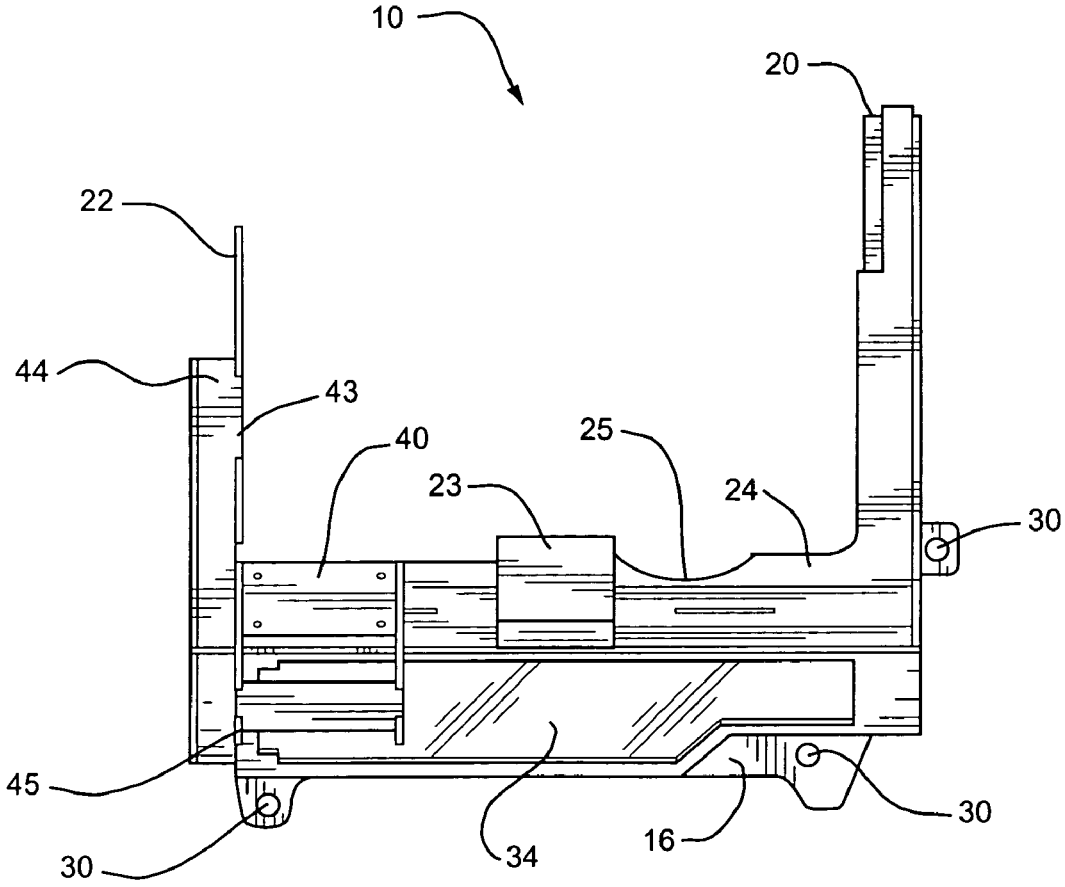
FIG. 9 is a top view of the armor shield assembly.

Referring to FIG. 9, a top view of the armor shield assembly 10 shows the left side transparent armor enclosure 44 attached to the left side armor frame 22 with the tabs 43, 45 fitted into notches 64 (FIG. 3) on the top edge of the left side armor frame 22. The top armor frame 24 extends over the right side armor frame section 20 but not over the enclosure 44 which has to be removable from the armor shield assembly 10 for passage of the engine cover on the armored vehicle 12. The concave edge 25 of the top armor frame 24 provides space for opening and closing the hatch cover 14. The mounting holes 30 are located in the bottom armor frame section 16.

Figure 10:
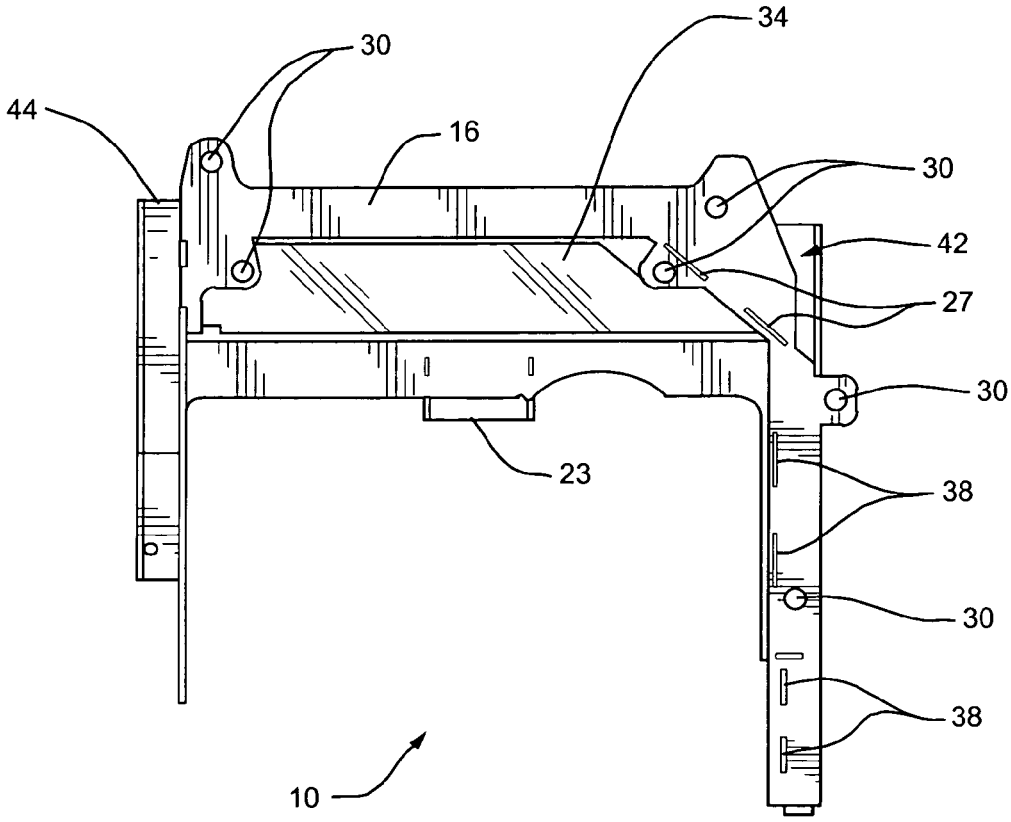
FIG. 10 is a bottom view of the armor shield assembly.

Referring now to FIG. 10, a bottom view of the armor shield assembly 10 is shown. Six mounting holes 30 are provided in the bottom armor frame 16. Slots 27, 38 are provided to assist in the initial assembly of the armor frame sections 16, 20 and plates 41, 49 are used to form channel 42 prior to welding of the tabs inserted into slots 27, 38.

All the pieces in the preferred embodiment of the ballistic armor shield assembly 10 including the armor frames sections 16, 18, 20, 22 and 24 are constructed from a ¼ inch thick, 4 ft.×8 ft. armor plates which are embodied by model BP6-33 manufactured by Astrolly Steel of Birmingham, Ala. One skilled in the art will recognize that other armor materials may be used instead of steel including titanium to provide additional protection or lighter weights.

All the armor pieces of the armor shield assembly 10 are cut from the 4 ft.×8 ft.×¼ inch armor plate by a laser cutting machine known in the art. The pieces are then assembled with the armor shield assembly 10 coming together like a jig-saw puzzle because of the tabs and slots, and then the pieces are welded in place. The camera mount 21 is secured to the top armor frame section 24 by three bolts (not shown). Also, the windshield wiper box 23 is secured to the top armor frame section 24 by a pair of bolts (not shown). The ballistic armor shield assembly 10 is installed on a Stryker armored vehicle 12 without the transparent armor sections 32, 34, 36 by removing six bolts from the armored vehicle 12 around the hatch 14, and after the armor shield 10 is placed over the six holes on the armored vehicle 12, the bolts are replaced through the six corresponding holes 30 in the bottom armor frame section 16 of the armor shield assembly 10. The right side transparent armor 36 is put into the right side armor frame section 10 and secured with a combination of a rubber gasket, two sided sticky tape, and silicone, commonly known in the art. The front transparent armor 34 is put into the front armor frame section 18 and secured with a rubber gasket, two sided sticky tape and silicone. On the left side of the armor shield assembly 10 is the enclosure 44, comprising the left side transparent armor 32 which is attached to the left side armor frame section 22 using four twist release knobs 28. The front armor cover 52 is attached to blocks 26 on the front armor from section 18 with four twist release knobs 28 and the right side armor cover is attached to blocks 26 on the right side armor frame 20 by four twist release knobs 28. The ballistic armor shield assembly 10 installation on a Stryker armored vehicle is completed in typically 1-2 hours. Once the three-sided armor shield assembly 10 is secured in place on the Stryker armored vehicle 12, the driver can drive the vehicle 12 with the hatch 14 in a fully or partially open position while in a secure environment provided by the armor shield assembly 10, and the driver has an unobstructed view forward as well as to the left and the right.

This invention has been disclosed in terms of a certain embodiment. It will be apparent that many modifications can be made to the disclosed apparatus without departing from the invention. Therefore, it is the intent of the appended claims to cover all such variations and modifications as come within the true spirit and scope of this invention.

What is claimed is:

1. An armor shield assembly for mounting adjacent to a rear pivot hatch on an armored vehicle comprising:

a front section having a first transparent armor secured within a front armor frame;

a right side section having a second transparent armor secured within a second frame, said right side section being attached perpendicular to a first end of said front section, and attached directly to the front section;

a left side section having a third transparent armor secured within a third frame, said left side section being attached perpendicular to a second end of said front section and attached directly to said front section;

a bottom frame, attached to lower edges of said right side section, said front section, and a portion of said left side section, comprises a plurality of mounting holes for receiving bolts to secure said assembly to said armored vehicle;

a top frame attached to upper edges of said right side section and said front section, and said armor shield assembly comprises an open area at the top between said front section, said right section and said left section for said rear pivot hatch to pass through when opened or closed, said hatch forming a cover for said top area of said armor shield assembly in accordance with positioning of said hatch by a driver of said vehicle.

2. The armor shield assembly as recited in claim 1 wherein said front section slopes backward at approximately a twenty degree angle with respect to a vertical axis perpendicular to a front leg of said bottom frame.

3. The armor shield assembly as recited in claim 1 wherein said third transparent armor comprises a cover for supporting said third transparent armor forming an enclosure, said enclosure being attached and positioned with tabs to said left side armor frame.

4. The armor shield assembly as recited in claim 1 wherein said armor assembly comprises:

a right side armor cover for positioning within a recessed border portion of said first transparent armor, said right side armor cover being secured to said second frame; and a front armor cover for positioning within a recessed border portion of said second transparent armor, said front armor cover being secured to said front frame.

5. The armor shield assembly as recited in claim 1 wherein a channel is provided in a lower corner below an intersection of said front section and said right side section, said channel providing an opening for a cable winch to pass through.

6. The armor shield assembly as recited in claim 1 wherein said top frame comprises a windshield wiper assembly.

7. The armor shield assembly as recited in claim 1 wherein said top frame comprises a camera bracket.

8. The armor shield assembly as recited in claim 1 wherein said left side section comprises a bracket having a hole, said bracket mounted perpendicular to said left side section for mounting of said armor shield assembly on said armored vehicle.

9. The armor shield assembly as recited in claim 1 wherein each of said first transparent armor, said second transparent armor, and said third transparent armor comprises a combination of layers of polycarbonate and glass to a predetermined thickness.

* * * * *